US005159151A

United States Patent [19]

Dransfield et al.

[11] Patent Number: 5,159,151

[45] Date of Patent: Oct. 27, 1992

[54] MISSILE NOSE FAIRING ASSEMBLY

[75] Inventors: Alfred E. Dransfield; Peter G. Waters, both of Stevenage, United Kingdom

[73] Assignee: British Aerospace Public Limited Company, London, England

[21] Appl. No.: 57,263

[22] Filed: Apr. 28, 1987

[30] Foreign Application Priority Data

May 8, 1986 [GB] United Kingdom ..... 8611403

[51] Int. Cl.[5] ..... F42B 10/52

[52] U.S. Cl. ..... 102/293; 102/377

[58] Field of Search ..... 102/213, 293, 340, 342, 102/351, 357, 377, 378, 393, 489, 505; 244/3.1, 3.16

[56] References Cited

U.S. PATENT DOCUMENTS 3,601,055 8/1971 Crockett ..... 102/377

3,674,227 7/1972 Jacobson et al. ..... 102/293

4,131,065 12/1978 Dietz ..... 102/377

4,498,394 2/1985 Regebro ..... 102/378

4,546,940 10/1985 Andersson et al. ..... 2244/3.1

4,646,642 3/1987 Nagler et al. ..... 102/378

*Primary Examiner*—Charles T. Jordan

*Attorney, Agent, or Firm*—Nixon & Vanderhye

[57] ABSTRACT

A separable nose fairing assembly includes a forward, massive portion slidably coupled to a rearward, light portion. Forward sliding movement of the massive portion relative to the light portion is limited by a stop. An explosive actuator is operable to drive the forward portion forwardly until it reaches the stop, whereupon the momentum transferred to the rearward portion is sufficient to pull it off the missile. Due to the high ballistic coefficient of the assembly it follows a ballistic trajectory different from that of the missile, thus minimizing the possibility of damage to the missile.

8 Claims, 2 Drawing Sheets

MISSILE NOSE FAIRING ASSEMBLY

BACKGROUND OF THE INVENTION

This invention relates to a nose fairing assembly for a missile containing in its nose region forward looking electro-optic equipment.

In a multiple launch rocket system the weapon includes a nose region housing electro-optic equipment behind a domed window and has two phases of flight; a ballistic phase and a final phase. During the ballistic phase there is a requirement that the missile nose have a low drag profile and that the domed window be protected from the effects of aerodynamic heating. It is also important that the missile be balanced for stability during this phase. In the final phase there is a requirement for an unobstructed dome for the electro-optic equipment.

In the past it has been proposed to enclose the dome with an ogival fairing constituted by a number of petals which are released prior to the final phase to fall away. In another proposal the dome is protected by enclosing it in a pre-stressed frangible glass cover designed to be shattered into small fragments in the final phase. Both these proposals however suffer from the disadvantage that debris produced when the dome is uncovered flies back over the missile and may damage the dome or other equipment associated with the missile e.g. the missile fins.

SUMMARY OF THE INVENTION

According to one aspect of this invention, there is provided a missile including a nose region having a window member, a separable nose fairing assembly separably connected to said missile and covering said window member and ejection means for moving said nose fairing assembly forwardly of the nose region to separate it therefrom, said nose region having a relatively high ballistic co-efficient.

By this arrangement, following operation of the ejection means, the missile and the nose fairing assembly each follow separate trajectories thereby to minimise the danger of collision.

Advantageously, said nose fairing assembly comprises a forward fairing portion and a rearward portion for releasable connection to said missile, said forward and rearward fairing portions being slidably coupled for movement between a stowed position in which the forward fairing portion blends smoothly with the adjacent area of the missile, and a forward limit position.

Preferably, the ejection means comprises an actuator to accelerate the forward fairing portion to the limit position thus imparting sufficient momentum to the rearward portion to cause it to separate from the missile. In this arrangement it is preferred for the forward portion to be relatively massive and the rearward portion to be relatively light so as both to generate a high shock load to separate the assembly from the missile and to give the separated nose fairing assembly good ballistic properties.

Moreover, this feature is also useful where it is desired to provide mass in the front end of the missile during the ballistic phase to stabilise the missile.

In one arrangement the ejection means comprises an explosive charge located in a variable volume chamber defined between said forward fairing portion and said rearward portion.

The rearward portion may be separably connected to said missile by means of frangible pins or some form of interference fit.

DESCRIPTION OF THE FIGURES

By way of example only, one specific embodiment of this invention will now be described in detail, reference being made to the accompanying drawings, in which.

DESCRIPTION OF THE PREFERRED EMBODIMENT

Figure 1:
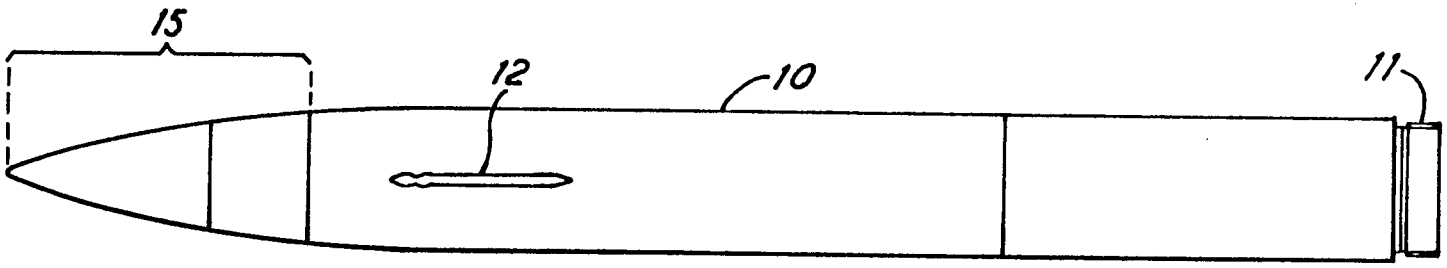
FIG. 1 is a side view of the forward portion of a missile provided with a separable nose fairing.

The missile illustrated in the Figures is intended to be rocket launched and to initially follow a ballistic trajectory until it reaches a final phase in which it acquires and intercepts a target under the guidance of signals from an optical seeker head contained in the nose region of the missile. During the ballistic phase it is necessary for the nose of the missile firstly to be protected against the effects of aerodynamic heating and secondly to carry ballast to stabilise the missile. During the final phase, it is necessary for the electro-optic equipment within the missile to have an unobstructed field of view, and there is no longer a requirement for a nose ballast because the propellant charge in the aft end of the rocket has been expended.

Referring to the Figures, the missile includes a main body portion 10 having at its aft end a collar 11 for attachment to a rocket motor (not shown). Adjacent its forward end the missile is provided with four stabilising fins 12 (only one of which is shown) and a domed window member 13 of material transmissive to optical radiation. Behind the window member is provided an electro-optic guidance head 14 for guiding the missile during its final phase. The window member 13 is covered and protected during launch and the ballistic phase by a separable nose fairing assembly 15. The assembly comprises a relatively massive forward fairing member 16 of ogival external shape and having an internal bore 17 with an inwardly protruding lip 18, and a rearward member 19 having a cup portion 20 secured to a flange 21 immediately behind the window member by means of four plastic shear pins 22, and a cylindrical stem portion 23. The stem portion is located within bore 17 and its external surface is in sliding contact with the inwardly protruding lip 18 of the bore. The stem 23 includes a bore 24 which receives an explosive charge 25 and which is capped by an apertured cap 26 screwed onto the free end of th stem portion. The cap 26 is of larger diameter than the cylindrical stem portion 23 and co-operates with the inwardly protruding lip 18 to provide a limit stop which limits relative movement of the forward fairing member 16 relative to the rearward member 19 and allows transfer of momentum from the former to the latter.

In use, the missile is launched with the nose fairing assembly 15 in the position illustrated in FIG. 1. The forward fairing member 16 serves both to protect the window member 13 against aerodynamic heating and any launch debris and also serves as a ballast to balance the missile.

Figure 3:
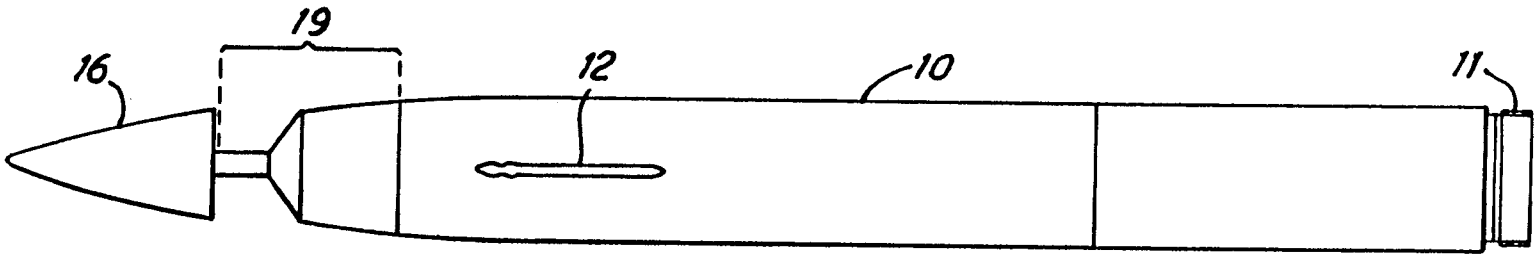
FIGS. 3 and 4 show successive stages in the separation of the nose fairing.
Figure 4:
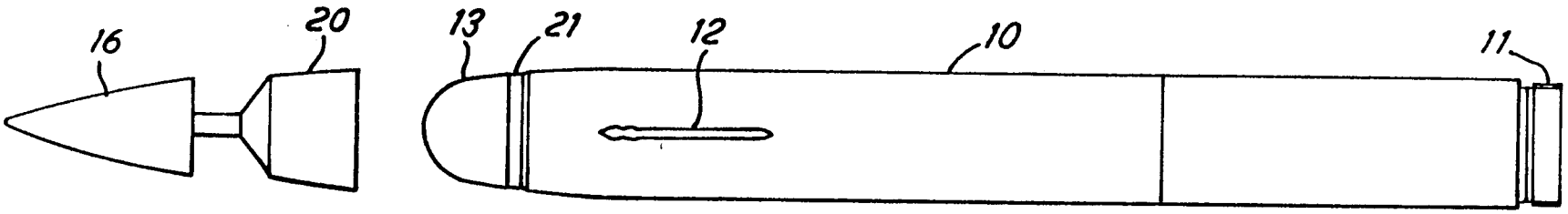
Figure 2:
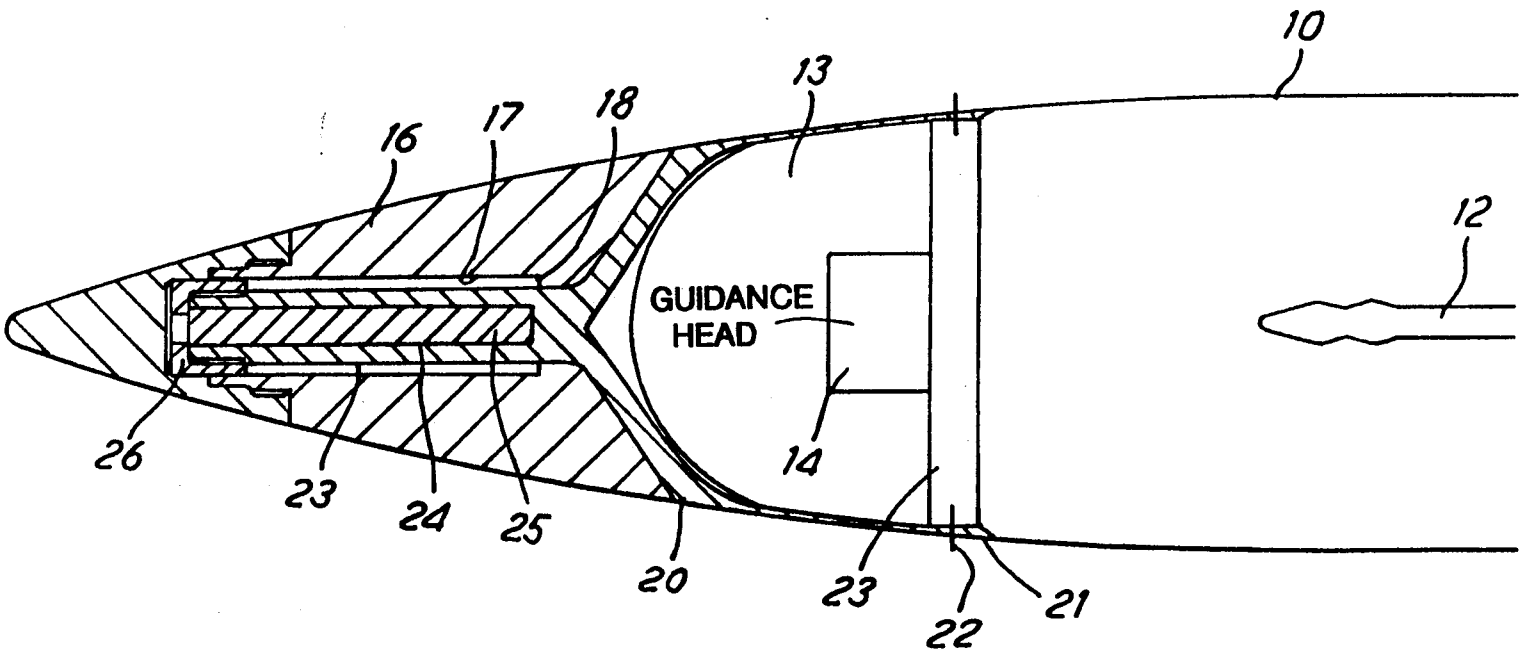
FIG. 2 is an enlarged side section view of the arrangement of FIG. 1.

As the missile enters its final phase, the explosive charge 25 is detonated and the forward firing member 16 is thrown forward by the action of the explosion gases against the closed end of the bore 17 until the lip 18 and the cap 26 engage (FIG. 3). Thereupon a shock load is imparted to the plastic shear pins 22 which fracture to allow the nose fairing assembly 15 to be ejected forwardly of the missile. As described above, the nose fairing assembly 15 has a relatively massive forward fairing member 16 and a relatively light rearward member 19 and thus the assembly has good flight properties. The nose fairing assembly 15 is designed to have a relatively high ballistic co-efficient so that the assembly and the missile follow separate ballistic trajectories thereby minimising the possibility of damage to the missile window or fins.

What is claimed is:

1. A missile including:

a missile main body including a forward window part;

fairing means covering a forward part of said missile main body and terminating adjacent a forward region of the missile main body to merge relatively smoothly with the adjacent surface of the missile main body, said fairing means being separable from the missile main body during flight thereof to uncover said forward window part of the missile main body;

said fairing means comprising:

a rearward fairing means for releasably connecting said fairing means to the missile main body;

a forward fairing part;

means for slidably mounting said forward fairing part on said rearward fairing means;

stop means for limiting forward sliding movement of said forward fairing part; and ejection means for moving said forward fairing part forwardly relative to said rearward fairing means, and for impacting said stop means thereby imparting a shock load to said rearward fairing means of sufficient magnitude to release said rearward fairing means from connection with said missile main body.

2. A missile according to claim 1, wherein said forward fairing part and said rearward fairing means have respective outer surfaces which merge smoothly together when the forward fairing surface and the rearward fairing surface are adjacent, and comprise means for defining a generally smooth and continuous ogival fairing.

3. A missile according to claim 1, wherein said fairing means terminates adjacent the merger of said forward window part with a remainder portion of said missile main body.

4. A missile according to claim 1, wherein said forward fairing part is relatively massive and the rearward fairing means is relatively light, for generating a high shock load to separate the fairing means from the missile and for giving the separated fairing means good ballistic properties.

5. A missile according to claim 1, wherein the ejection means comprises an explosive charge located in a variable volume chamber defined between said forward fairing part and said rearward fairing means.

6. A missile according to claim 1, wherein said rearward fairing means is separably connected to said missile main body by frangible pins.

7. A missile according to claim 1, wherein said rearward fairing means is separably connected to said missile main body by a snap fit.

8. A missile including:

a main body portion;

a nose portion including a generally convex window member on a forward end of said main body portion; and a separable nose fairing assembly covering said window member, said fairing assembly terminating adjacent a forward part of the missile main body portion to merge smoothly with the missile main body portion and being separable from the missile during flight to uncover said window member;

said separable nose fairing assembly comprising:

a forward fairing portion of generally ogival external shape;

a rearward fairing portion, releasably connected to said missile and being relatively light in comparison to said forward fairing portion and being mounted for sliding movement with respect thereto;

stop means limiting sliding movement of said forward and said rearward fairing portions; and ejection means for driving said forward fairing portion forward to impact said stop means and for imparting to said rearward fairing portion a shock load of sufficient magnitude to release said rearward fairing portion from connection with said missile main body portion.

* * * * *